US006681452B1

(12) United States Patent
Holland

(10) Patent No.: US 6,681,452 B1
(45) Date of Patent: Jan. 27, 2004

(54) CLAMPING APPARATUS WITH REMOVABLE ATTACHMENTS

(75) Inventor: Jason S. Holland, Raleigh, NC (US)

(73) Assignee: Adstracts, Inc., Raleigh, NC (US)

( * ) Notice: Subject to any disclaimer, the term of this patent is extended or adjusted under 35 U.S.C. 154(b) by 0 days.

(21) Appl. No.: 10/256,744

(22) Filed: Sep. 27, 2002

(51) Int. Cl.[7] ..... A44B 21/00; B42D 17/00; B42F 1/00; B65H 1/00

(52) U.S. Cl. ..... 24/67.3; 24/67 R; 24/67.5; 24/67.7; 24/457; 24/531; 221/33; 221/46; 248/449; 248/452

(58) Field of Search ..... 24/67 R, 67.3, 24/67.7, 457, 531; 248/449, 452; 221/33, 34, 35, 46

(56) References Cited

U.S. PATENT DOCUMENTS

| | | | | | |
|---|---|---|---|---|---|
| 1,215,643 | A | | 2/1917 | Fuller | |
| 2,586,732 | A | * | 2/1952 | Sohier | 24/67 R |
| 3,105,279 | A | * | 10/1963 | Westhoff | 24/67.5 |
| 4,173,358 | A | | 11/1979 | Wilson | 281/45 |
| 4,416,392 | A | | 11/1983 | Smith | 221/45 |
| 4,562,618 | A | * | 1/1986 | Masuda | 24/67.7 |
| 4,586,630 | A | | 5/1986 | Loder | 221/46 |
| 4,770,320 | A | | 9/1988 | Miles et al. | 221/33 |
| 4,993,590 | A | | 2/1991 | Windorski | 221/46 |
| 5,080,254 | A | | 1/1992 | Feer | 221/33 |
| 5,116,012 | A | | 5/1992 | Offenhauer et al. | 248/452 |
| D331,074 | S | | 11/1992 | Dotterman et al. | D19/86 |
| D332,114 | S | | 12/1992 | Offenhauer et al. | D19/88 |
| 5,167,346 | A | | 12/1992 | Bodziak | 221/63 |
| 5,180,133 | A | | 1/1993 | Chang | 248/452 |
| 5,222,763 | A | | 6/1993 | Garza | 281/29 |
| D342,759 | S | | 12/1993 | Kirchhoff et al. | D19/86 |
| 5,276,986 | A | | 1/1994 | Thomas | 40/336 |
| 5,283,091 | A | | 2/1994 | Darvell et al. | 428/40 |
| D348,484 | S | | 7/1994 | Blackwell et al. | D19/69 |
| 5,363,985 | A | * | 11/1994 | Cornell | 221/46 |
| 5,401,547 | A | | 3/1995 | Blackwell et al. | 428/40 |
| 5,413,382 | A | | 5/1995 | Cornell et al. | 281/45 |
| 5,427,413 | A | | 6/1995 | Garza | 281/29 |
| 5,697,518 | A | | 12/1997 | Callahan, Jr. | 221/34 |
| 5,732,925 | A | | 3/1998 | Shamoon | 248/452 |
| 5,758,902 | A | | 6/1998 | McManus | 281/45 |
| 5,769,270 | A | | 6/1998 | Fujisawa et al. | 221/34 |
| 5,774,946 | A | * | 7/1998 | Morgan | 24/67.5 |
| 5,881,434 | A | * | 3/1999 | Rigney | 24/531 |
| 5,964,375 | A | | 10/1999 | Carlson et al. | 221/45 |
| D416,411 | S | | 11/1999 | Carlson et al. | D6/515 |
| D419,601 | S | | 1/2000 | Windorski | D19/86 |
| 6,024,384 | A | | 2/2000 | Jones et al. | 281/45 |
| D425,737 | S | | 5/2000 | Carlson et al. | D6/515 |
| D428,926 | S | | 8/2000 | Windorski | D19/86 |
| 6,095,477 | A | | 8/2000 | Pohlman | 248/452 |
| 6,175,082 | B1 | * | 1/2001 | Klinger et al. | 24/457 |
| 6,217,075 | B1 | * | 4/2001 | Tsai | 248/452 |

* cited by examiner

*Primary Examiner*—Victor Sakran
(74) *Attorney, Agent, or Firm*—Myers Bigel Sibley & Sajovec

(57) ABSTRACT

A clamping apparatus having a flexible sheet dispenser attached thereto is provided. The clamping apparatus includes a base member, an upper member pivotally attached to the base member, and a flexible sheet dispenser removably secured to the upper member. The flexible sheet dispenser includes a housing and a flexible sleeve containing one or more stacks of flexible sheets disposed within the housing. The flexible sleeve is configured to individually dispense flexible sheets from one or more stacks disposed within the flexible sleeve. The flexible sleeve comprises opposite edge portions that are engaged by retaining members in the housing such that the flexible sleeve is maintained in arcuate, face-to-face contacting relationship with the arcuate wall surface.

33 Claims, 7 Drawing Sheets

CLAMPING APPARATUS WITH REMOVABLE ATTACHMENTS

FIELD OF THE INVENTION

The present invention relates generally to clamping devices and, more particularly, to multi-functional clamping devices.

BACKGROUND OF THE INVENTION

The use of promotional items has proliferated in today's increasingly competitive marketplace, where companies are constantly seeking more effective and new ways to market their products. In the healthcare industry, physicians and other healthcare providers often receive promotional articles from vendors of healthcare-related products, such as pharmaceutical products. These promotional articles often include "everyday" items, such as writing pads, calendars, containers, and pens that have promotional information (indicia) printed thereon. For example, pharmaceutical companies often provide physicians with writing pens having the name of a particular pharmaceutical product printed thereon with the hopes that the pens will help remind the physicians to prescribe the particular pharmaceutical product.

Unfortunately, because of lack of distinctiveness, many promotional articles provided to healthcare providers often become "lost-in-the-shuffle" with other promotional articles. Thus, there is a need for distinctive, more effective promotional products directed to physicians and other healthcare providers.

SUMMARY OF THE INVENTION

In light of the above discussion, a clamping apparatus for use in retaining documents and/or other objects is provided with a flexible sheet dispenser attached thereto. The clamping apparatus includes a base member, an upper member that is pivotally attached to the base member, and a flexible sheet dispenser that is removably secured to the upper member. The flexible sheet dispenser includes a housing and a flexible sleeve containing one or more stacks of flexible sheets disposed within the housing.

According to embodiments of the present invention, the housing has an arcuate wall with an elongated slot formed therein. The arcuate wall includes opposite elongated edge portions, opposite end portions, an arcuate surface, and a pair of retaining members each of which protrudes from the arcuate wall surface adjacent a respective one of the arcuate wall edge portions. A pair of end walls depend from respective opposite end portions of the arcuate wall. Each housing end wall includes a locking tab depending therefrom that is configured to be inserted within a respective aperture formed within the upper member so as to enable the housing to be removably secured to the upper member front face.

The flexible sleeve is configured to individually dispense flexible sheets from one or more stacks disposed within the flexible sleeve. The flexible sleeve comprises opposite edge portions that are engaged by the retaining members such that the flexible sleeve is maintained in arcuate, face-to-face contacting relationship with the arcuate wall surface, and such that a free end of an uppermost sheet in a stack extends through the arcuate wall elongated slot.

According to embodiments of the present invention, the flexible sleeve includes a generally planar base section having opposite edge portions, and a pair of elastically deformable members each extending from a respective base section edge portion toward the other elastically deformable member in overlapping spaced relationship to the base section. Each elastically deformable member has a free edge that is spaced from and opposing the other elastically deformable member free edge, thereby defining an opening therebetween through which a free end of an uppermost sheet in a stack extends.

According to embodiments of the present invention, the housing arcuate wall elongated slot includes opposite end portions and a respective post that extends from the housing arcuate wall surface adjacent each elongated slot end portion. The posts are configured to limit movement of the flexible sleeve relative to the elongated slot.

BRIEF DESCRIPTION OF THE DRAWINGS

The accompanying drawings, which are incorporated in and constitute a part of the specification, illustrate embodiments of the invention and, together with the description, serve to explain principles of the invention.

DETAILED DESCRIPTION OF THE INVENTION

Figure 1:
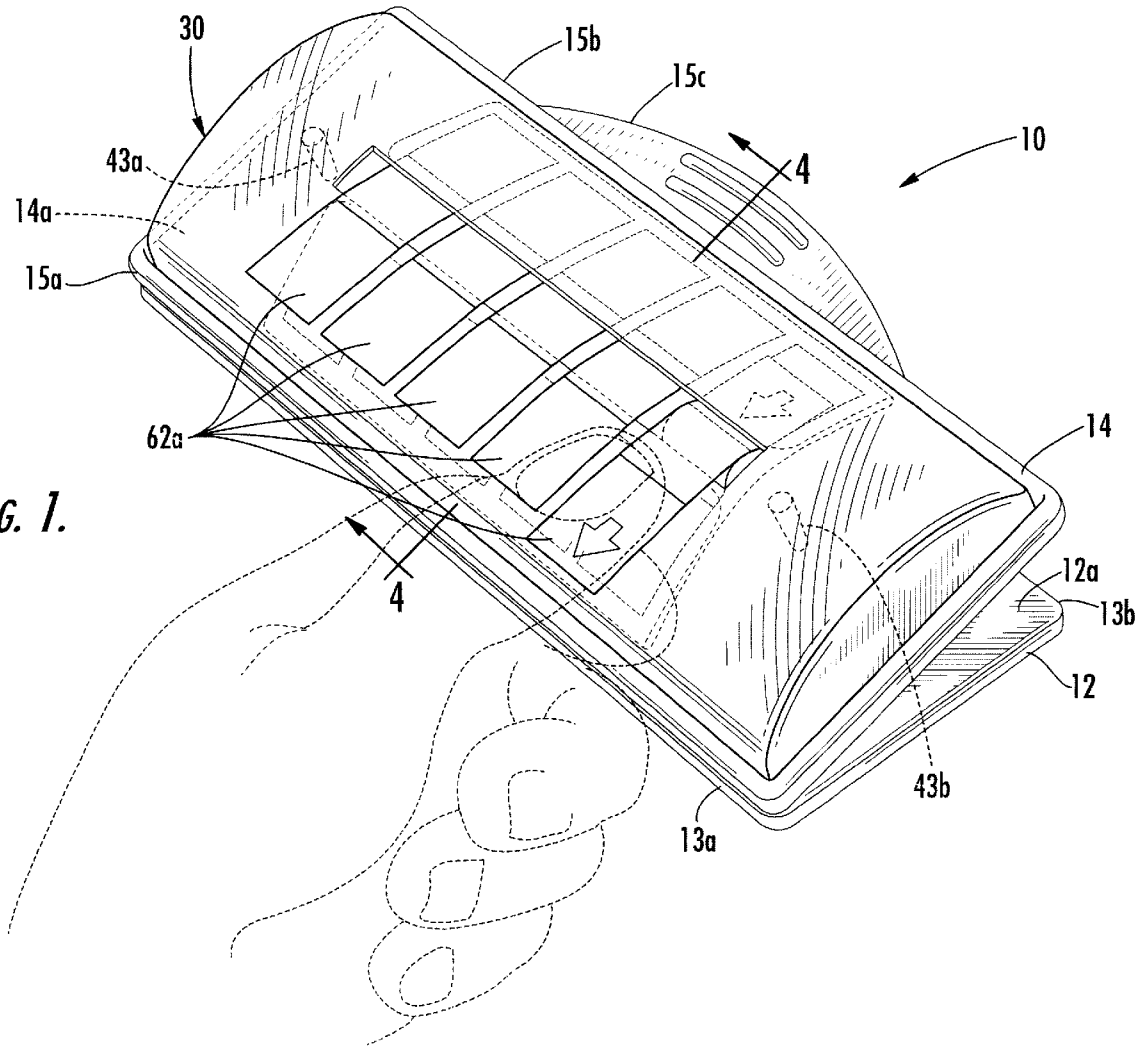
FIG. 1 is a front perspective view of a clamping apparatus according to embodiments of the present invention.

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

In the drawings, the thickness of lines, layers and regions may be exaggerated for clarity. It will be understood that when an element is referred to as being "on" another element, it can be directly on the other element or intervening elements may also be present. In contrast, when an element is referred to as being "directly on" another element, there are no intervening elements present. It will be understood that when an element is referred to as being "connected" or "attached" to another element, it can be directly connected or attached to the other element or intervening elements may also be present. In contrast, when an element is referred to as being "directly connected" or "directly attached" to another element, there are no intervening elements present.

Referring to FIGS. 1–7, a clamping apparatus 10, according to embodiments of the present invention, is illustrated and includes a base member 12, an upper member 14 having a front face 14*a*, and a flexible sheet dispenser 30 removably secured to the upper member front face 14*a*. The upper member 14 is movably secured to the base member 12 via hinges 18 (FIGS. 4,7) for pivotal movement about an axis A. The base member 12 has opposite front and rear faces 12*a*, 12*b* and a forward and rearward edge portions 13*a*, 13*b*. The upper member 14 has opposite front and rear faces 14*a*, 14*b*, opposite end portions 14*c*, 14*d* and opposite forward and rearward edge portions 15*a*, 15*b*. A portion 15*c* of the rearward edge portion 15*b* of the upper member 14 has an arcuate configuration, as illustrated. This arcuate configuration facilitates a user pressing thereon to separate the forward edge portions 13*a*, 15*a* of the base and upper members 12, 14, respectively.

In the illustrated embodiment, the base member 12 has a generally planar configuration. The upper member 14 has a generally planar configuration with a raised edge 16 extending around the periphery of front face 14*a* to define a recessed portion 17. The illustrated upper member front face 14*a* also includes a respective aperture 19 formed therein adjacent each front face end portion 14*c*, 14*d*. The apertures 19 are configured to removably receive a respective pair of locking tabs 44 (FIG. 3) in the flexible sheet dispenser housing 40, described below.

The base and upper members 12, 14 may have various shapes, sizes and configurations according to embodiments of the present invention. The base and upper members 12, 14 may include various types of indicia thereon (e.g., promotional indicia). Embodiments of the present invention are not limited to the illustrated base and upper members 12, 14. Moreover, the base and upper members 12, 14 may be formed from various types of materials without limitation (e.g., polymeric materials, metals, wood, glass, etc.). The base and/or upper members 12, 14 may be translucent and/or transparent and/or may have portions thereof that are translucent and/or transparent.

Figure 2:
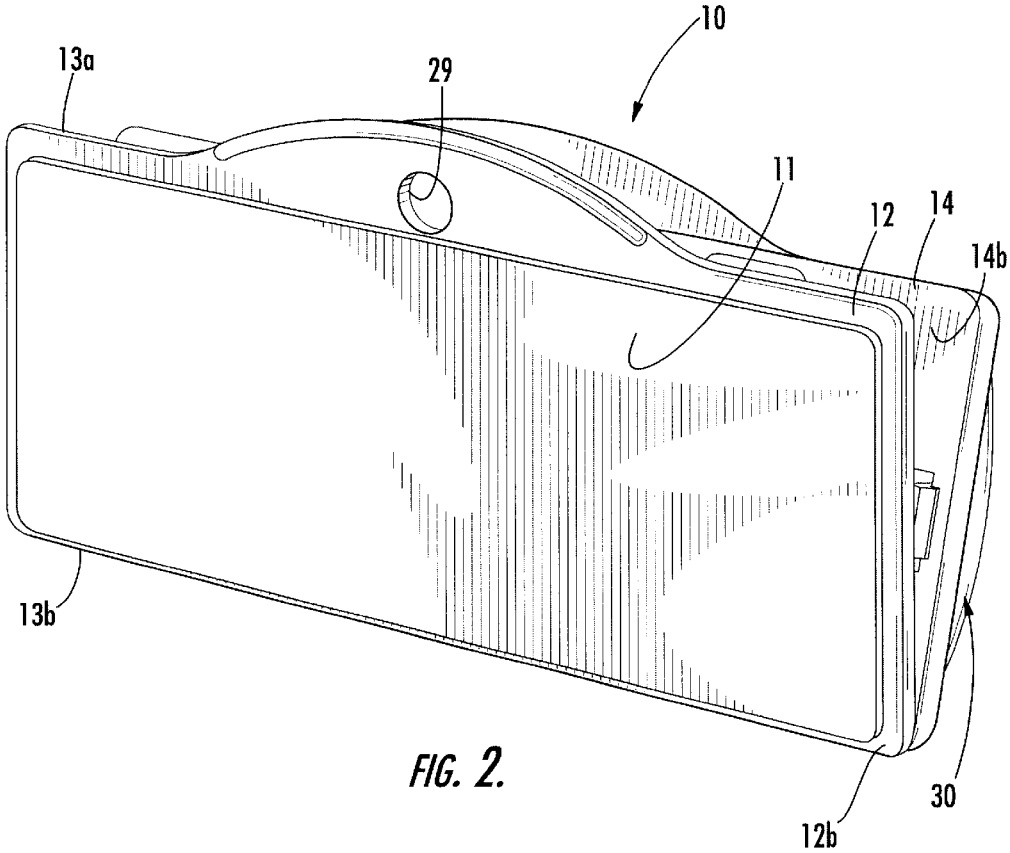
FIG. 2 is a rear perspective view of the clamping apparatus of FIG. 1.
Figure 3:
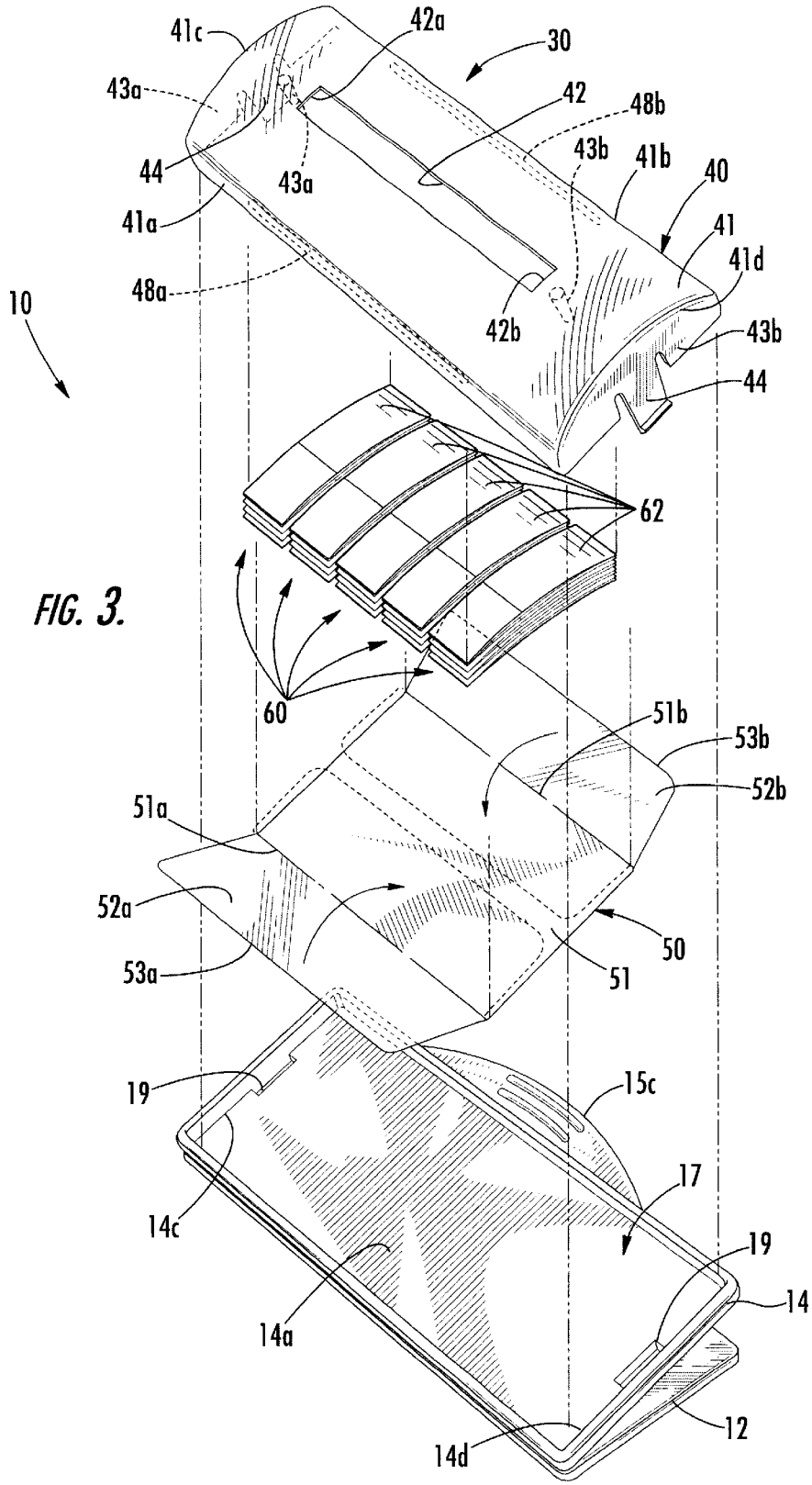
FIG. 3 is an exploded perspective view of the clamping apparatus of FIG. 1.

In the illustrated embodiment of FIG. 2, the base member rear surface 12*b* includes a magnet 11 attached thereto that is configured to removably secure the clamping apparatus 10 to a magnetically attractive surface. The illustrated base member 12 also includes an aperture 29 formed therein adjacent rearward edge portion 15*c* that is configured to secure the clamping apparatus 10 to a substantially vertical surface via a fastener (e.g., nail, screw, bolt, hook, etc.), as would be understood by those skilled in the art. Adhesives may also be utilized to secure the clamping apparatus 10 to an object.

Figure 4:
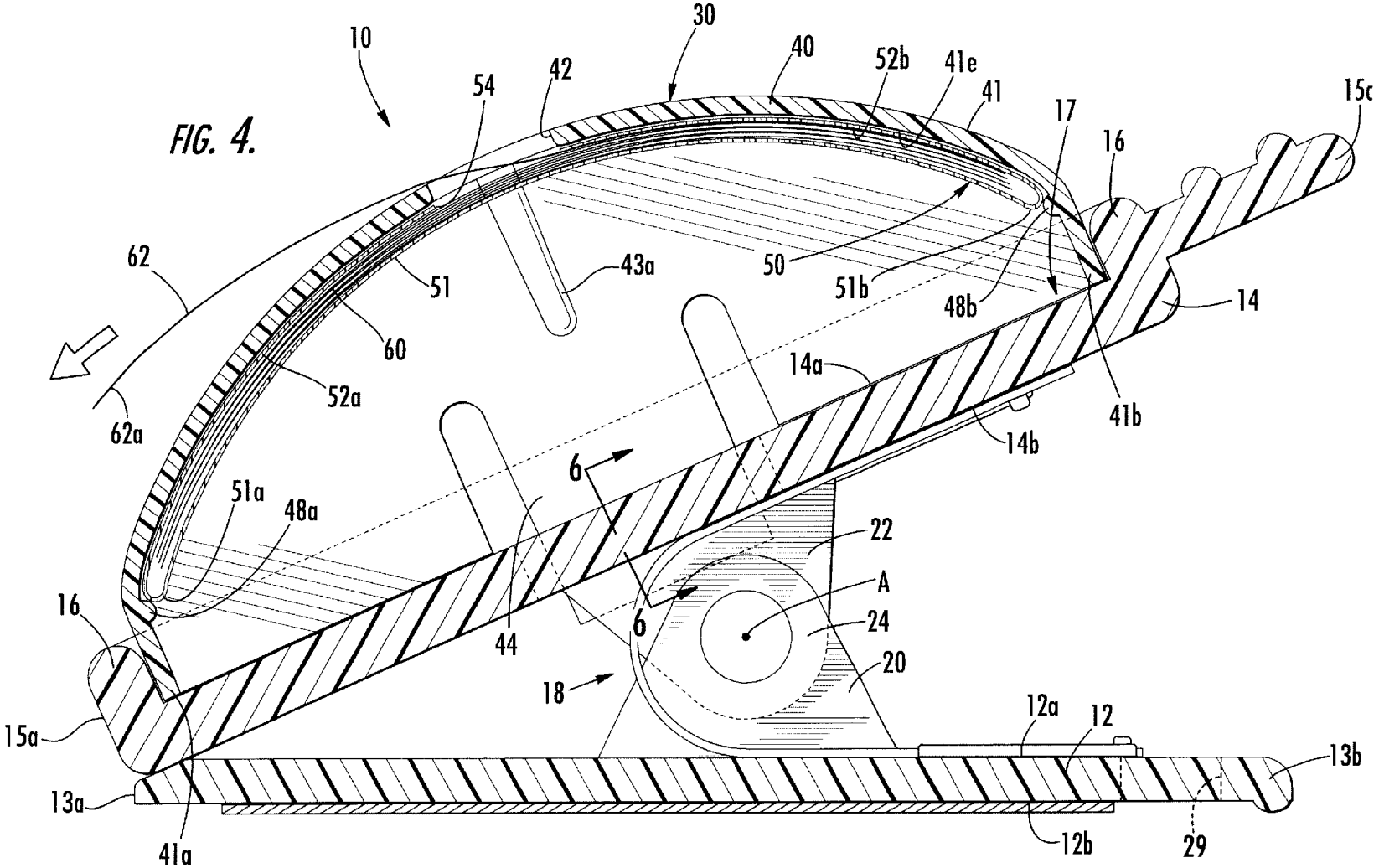
FIG. 4 is a side section view of the clamping apparatus of FIG. 1 taken along lines 4—4.

In the illustrated embodiment, two pairs of spaced-apart hinges 18 (FIG. 7) are utilized to pivotally attach the upper member 14 to the base member 12. Referring to FIG. 4 each hinge 18 includes a first member 20 extending from the base member front surface 12*a* and a second member 22 extending from the upper member rear surface 14*b*. The first and second members 20, 22 of each hinge 18 are pivotally connected to each other via pin 24. The pin 24 may be integrally formed with either the first or second member 20, 22 and extend therefrom so as to be received within an aperture in the other member to provide pivotal movement of the first and second members 20, 22 relative to one another. Alternatively, the pin 24 may be a separate member that is received in respective apertures in the first and second members 20, 22 as would be understood by those skilled in the art.

As illustrated, a spring element 26 is positioned between each respective pair of spaced-apart hinges 18 and is configured to bias the upper member 14 about the axis A such that the upper member forward edge portion 15*a* is urged towards the base member forward edge portion 13*a* to retain items placed therebetween (e.g., documents, etc.). The illustrated spring elements 26 are leaf-type springs having opposite end portions 26*a*, 26*b*. End portion 26*a* is securely attached to the upper member rear surface 14*b* and opposite end portion 26*b* is securely attached to the base member front surface 12*a*.

Embodiments of the present invention are not limited to the illustrated hinge 18 and spring element 26 configurations. Various types, shapes and configurations of hinges and springs may be utilized in accordance with embodiments of the present invention. Moreover, the spring elements 26 may be attached to the upper member 14 and base member 12 is various ways to facilitate pivotal movement about axis A.

In the illustrated embodiment, the flexible sheet dispenser 30 is removably secured to the upper member 14 within the recessed portion 17 of the front face 14*a*. The flexible sheet dispenser 30 includes a housing 40 and a flexible sleeve 50 disposed within the flexible sleeve 50, wherein the flexible sleeve 50 is configured to individually dispense flexible sheets 62 from one or more stacks 60.

The illustrated housing 40 includes an arcuate wall 41 having an elongated slot 42 formed therein. The arcuate wall 41 includes opposite elongated edge portions 41*a*, 41*b*, opposite end portions 41*c*, 41*d*, and an arcuate surface 41*e*. A pair of end walls 43*a*, 43*b* depend from respective opposite end portions 41*c*, 41*d* of the arcuate wall 41, as illustrated. Each housing end wall 43*a*, 43*b* includes a locking tab 44 depending therefrom that is configured to be inserted within a respective one of the apertures 19 in the upper member front face 14*a* so as to removably secure the housing 40 to the upper member front face 14*a*.

The illustrated arcuate wall elongated slot 42 includes opposite end portions 42*a*, 42*b*. A respective post 43*a*, 43*b* extends from the housing arcuate wall surface 41*e* adjacent each elongated slot end portion 42*a*, 42*b*, as illustrated. The posts 43*a*, 43*b* are configured to limit movement of the flexible sleeve 50 relative to the elongated slot 42 when the flexible sleeve 50 is in arcuate, contacting face-to-face relationship with the arcuate wall surface 41*e*, as described below.

Figure 5:
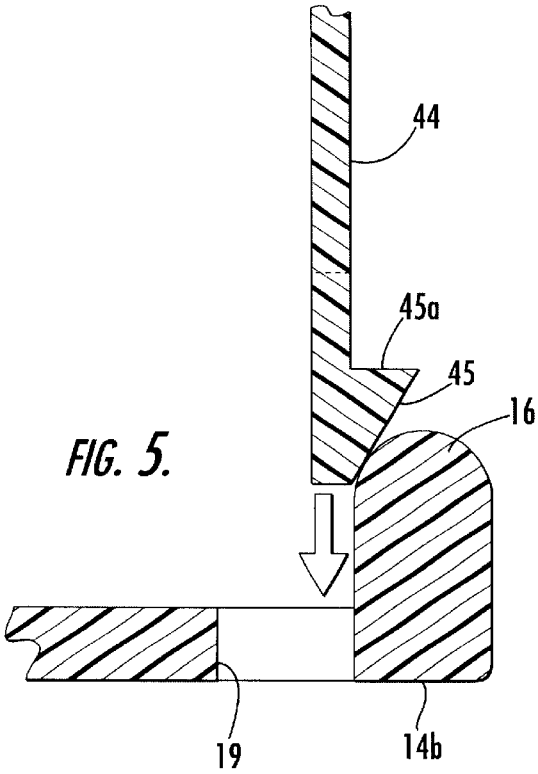
FIGS. 5–6 illustrate insertion of a housing end wall locking tab into a respective aperture in the upper member front face for removably securing the housing to the upper member front face, according to embodiments of the present invention.
Figure 6:
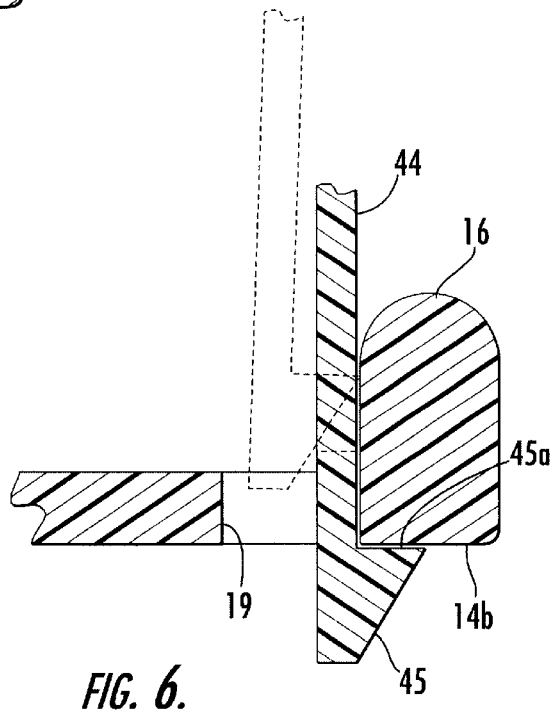
Figure 7:
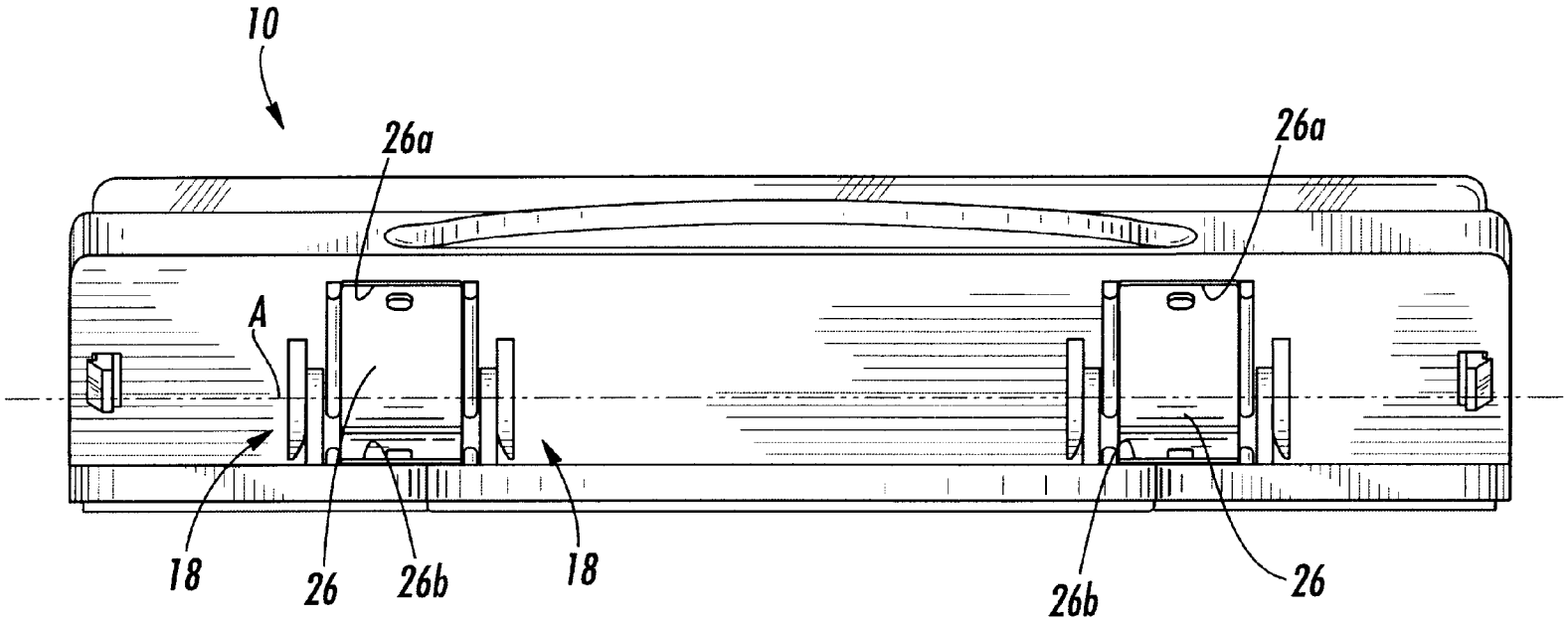
FIG. 7 is a rear elevation view of the clamping apparatus of FIG. 1.

FIGS. 5–6 illustrate the insertion of a locking tab 44 within an aperture 19 in the upper member 14 so as to removably secure the housing 40 to the upper member front face 14*a*. Only one locking tab 44 and aperture 19 are illustrated. However, the illustrations and descriptions apply to both locking tabs 44.

The illustrated locking tab 44 has a barb-shaped free end portion 45 with a shoulder 45*a*. When inserted within aperture 19 and moved downwardly into the aperture, the locking tab 44 is deflected slightly by the raised edge 16 (FIG. 5) until the shoulder 45*a* of the barbed-shaped free end portion 45 engages the rear face 14*b* of the upper member 14 (FIG. 6). In the position illustrated in FIG. 6, the locking tabs 44 removably secure the housing 40 to the upper member front face 14*a*. To remove the housing 40 from the upper member front face 14*a*, a user squeezes the locking tabs 44 towards each other such that the shoulder 45*a* of each barbed-shaped free end portion 45 is free of the upper member rear face 14*b*.

Embodiments of the present invention are not limited to the illustrated locking tab 44 and aperture 19 configurations. Various types, shapes and configurations of locking tabs and apertures may be utilized in accordance with embodiments of the present invention.

Referring back to FIG. 3, the flexible sleeve 50 is configured to individually dispense flexible sheets 62 from respective stacks 60 disposed within the flexible sleeve 50. The illustrated flexible sleeve 50 includes a generally planar base section 51 having opposite edge portions 51*a*, 51*b*. A pair of elastically deformable members 52*a*, 52*b* extend from respective base section edge portions 51*a*, 51*b* towards each other in overlapping spaced relationship to the base section 51, as illustrated in FIG. 4. Each elastically deformable member 52*a*, 52*b* has a free edge 53*a*, 53*b* that is spaced from and opposing the other elastically deformable member free edge, thereby defining an opening 54 therebetween through which a free end 62*a* of an uppermost sheet 62 in a stack 60 extends. The flexible sleeve 50 may include various types of indicia thereon (e.g., promotional indicia), and in one or more locations.

The housing arcuate wall surface 41*e* comprises a pair of retaining members 48*a*, 48*b*, each of which protrudes from the arcuate wall surface 41*e* adjacent a respective one of the arcuate wall edge portions 41*a*, 41*b*. Each retaining member 48*a*, 48*b* is configured to engage a respective edge portion 51*a*, 51*b* of the flexible sleeve 50 such that the flexible sleeve 50 is maintained in arcuate, face-to-face contacting relationship with the arcuate wall surface 41*e*, as illustrated in FIG. 4.

When the flexible sleeve 50 is in arcuate, face-to-face contacting relationship with the arcuate wall surface 41*e*, the opening 54 between the elastically deformable member free edges 53*a*, 53*b* is in communication with the elongated slot 42 in the housing 40 such that the free end 62*a* of an uppermost sheet 62 in each stack 60 of flexible sheets 62 extends through the arcuate wall elongated slot 42. In the illustrated embodiment, a plurality of stacks 60 of flexible sheets 62 are disposed within the flexible sleeve 50 in adjacent, spaced-apart relationship, and a free end 62*a* of an uppermost sheet 62 in each stack 60 extends through the arcuate wall elongated slot 42.

In the illustrated embodiment, each retaining member 48*a*, 48*b* is an elongated rib that protrudes from the arcuate wall surface 41*e* and extends along a direction substantially parallel with a respective one of the arcuate wall edge portions 41*a*, 41*b*. However, embodiments of the present invention may incorporate retaining members having various shapes, sizes, and configurations, without limitation.

In the illustrated embodiment of FIGS. 1–4, the elastically deformable members 52*a*, 52*b* of the flexible sleeve 50 are formed of a transparent material. In addition, the housing 40 is formed of a transparent material, thereby allowing the stacks 60 of flexible sheets 62 disposed within the flexible sleeve 50 to be seen through the housing 40.

The flexible sheet dispenser 30 is configured to dispense flexible sheets 62 from one or more stacks 60 comprising a plurality of the sheets 62 disposed one on top of another. Each sheet 62 has a band of pressure sensitive adhesive coated on one surface adjacent one edge thereof and is free of adhesive coating along a portion adjacent an opposite edge thereof. The sheets 62 are stacked with the adhesive coating on each successive sheet disposed along alternate opposite sides of a stack 60 and releasably adhere the sheets together to maintain the sheets in the stack. By grasping the free end portion 62*a* the uppermost sheet 62 on a stack can be manually pulled through the elongated slot 42 and will carry with it the adhesive free end portion of the sheet 62 beneath it in the stack 60 to which the uppermost sheet 62 is adhered by the adhesive coating on the uppermost sheet 62, placing that adhesive-free end portion in a position where it also may be grasped and pulled to withdraw the next sheet 62 from the stack 60.

The flexible sheet dispenser 30 is configured to dispense various types of flexible sheets that are commercially available. Exemplary flexible sheets include various Post-it® brand self-stick products available from the 3M Company, St. Paul, Minn.

Figure 8:
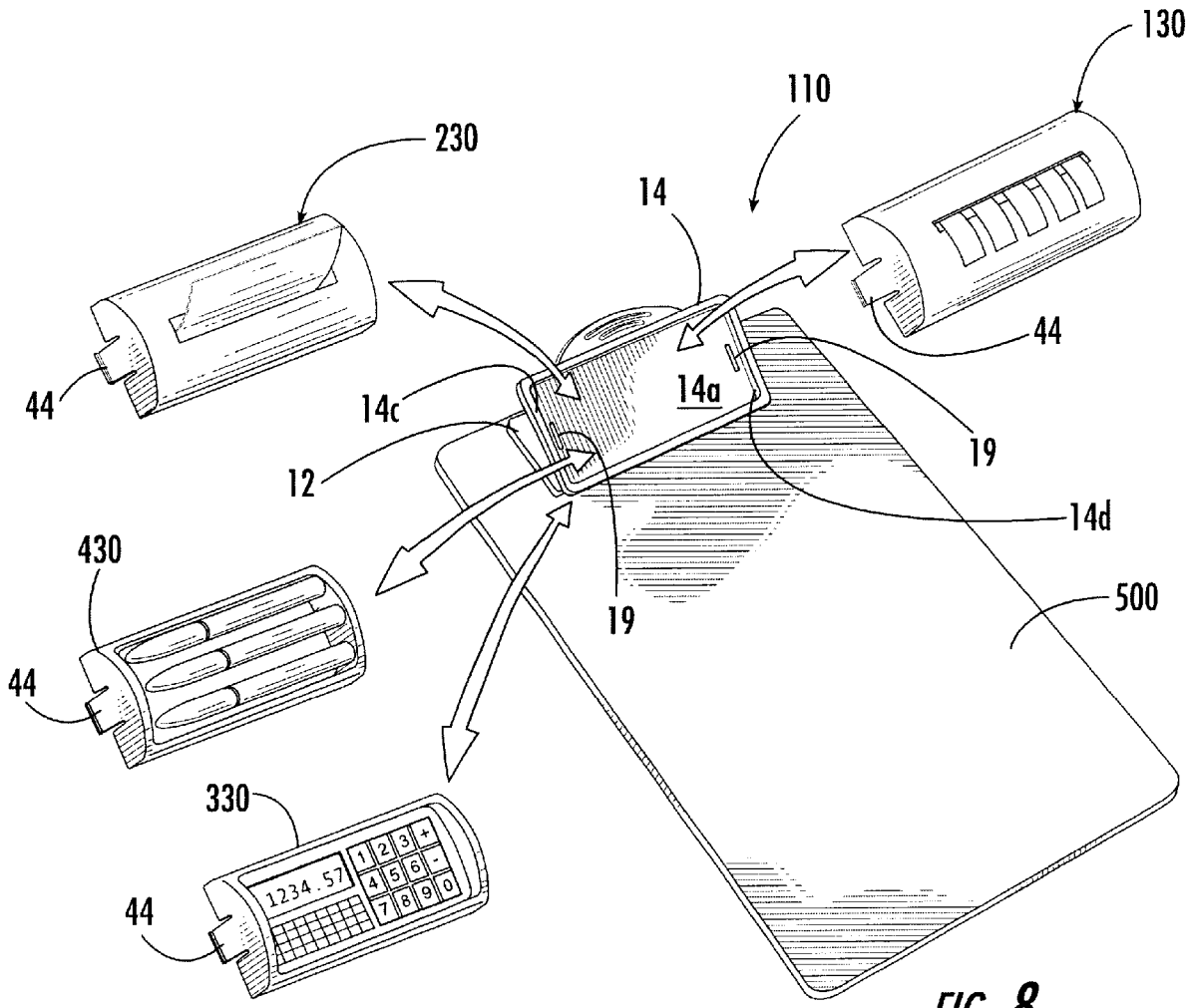
FIG. 8 is a perspective view of a clamping apparatus according to embodiments of the present invention.

Referring to FIG. 8, a clamping apparatus 110, according to embodiments of the present invention, is illustrated. The clamping apparatus 110 is similar to the clamping apparatus 10 described-above and illustrated in FIGS. 1–7 in appearance and function, but also includes a set of articles each of which is configured to be removably secured to the upper member front face 14*a*. In the illustrated embodiment, the set of articles includes flexible sheet dispensers 130, 230, an electronic apparatus (e.g., a calculator, etc.) 330, and a writing instrument holder 430.

In the illustrated embodiment, the upper member front face 14*a* includes a respective aperture 19 formed therein adjacent each front face end portion 14*c*, 14*d*. Each article 130, 230, 330, 430 includes locking tabs 44 depending therefrom that are configured to be inserted within the respective apertures 19 so as to removably secure the article to the upper member front face 14*a*, as described above with respect to FIGS. 1–7. However, other ways of removably attaching each article 130, 230, 330, 430 to the upper member front face 14*a* may be utilized including, but not limited to, hook and loop fasteners, magnets, adhesives, etc.

In the illustrated embodiment, the clamping apparatus 110 is attached to a clipboard 500. However, the clamping apparatus 110 may be attached to various objects, including walls, cabinets, appliances, etc. via magnets, adhesives, and/or fasteners of various types.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A clamping apparatus, comprising:

a base member;

an upper member including a front face and an edge portion, the upper member movably secured to the base member for pivotal movement about an axis;

a biasing member that biases the upper member about the axis such that the upper member edge portion is biased towards the base member to retain items placed therebetween; and a flexible sheet dispenser removably secured to the upper member front face, wherein the flexible sheet dispenser comprises:

a housing, comprising:

an arcuate wall having an elongated slot formed therein, wherein the arcuate wall includes opposite elongated edge portions, opposite end portions and an arcuate surface; and a pair of end walls depending from respective opposite end portions of the arcuate wall; and a flexible sleeve configured to individually dispense flexible sheets from a stack disposed within the flexible sleeve, wherein the flexible sleeve is in arcuate, face-to-face contacting relationship with the arcuate wall surface, and wherein a free end of an uppermost sheet in the stack extends through the arcuate wall elongated slot.

2. The clamping apparatus of claim 1, wherein the arcuate wall surface comprises a pair of retaining members each of which protrudes from the arcuate wall surface adjacent a respective one of the arcuate wall edge portions, and wherein each retaining member is configured to engage a respective edge portion of the flexible sleeve such that the flexible sleeve is maintained in arcuate, face-to-face contacting relationship with the arcuate wall surface.

3. The clamping apparatus of claim 2, wherein each retaining member comprises an elongated rib that protrudes from the arcuate wall surface and extends along a direction substantially parallel with a respective one of the arcuate wall edge portions.

4. The clamping apparatus of claim 1, wherein the flexible sleeve comprises:

a generally planar base section having opposite edge portions; and a pair of elastically deformable members each extending from a respective base section edge portion toward the other elastically deformable member in overlapping spaced relationship to the base section, wherein each elastically deformable member has a free edge that is spaced from and opposing the other elastically deformable member free edge, thereby defining an opening therebetween through which a free end of an uppermost sheet in the stack extends.

5. The clamping apparatus of claim 1, wherein the upper member front face comprises opposite end portions and a respective aperture formed therein adjacent each front face end portion, and wherein each housing end wall comprises a locking tab depending therefrom that is configured to be inserted within a respective one of the apertures so as to removably secure the housing to the upper member front face.

6. The clamping apparatus of claim 1, wherein a plurality of stacks of flexible sheets are disposed within the flexible sleeve in adjacent, spaced-apart relationship, and wherein a free end of an uppermost sheet in each stack extends through the arcuate wall elongated slot.

7. The clamping apparatus of claim 4, wherein the elastically deformable members of the flexible sleeve are formed of a transparent material, thereby allowing the stack of flexible sheets disposed within the flexible sleeve to be seen through the elastically deformable members.

8. The clamping apparatus of claim 7, wherein the housing is formed of a transparent material, thereby allowing the stack of flexible sheets disposed within the flexible sleeve to be seen through the housing.

9. The clamping apparatus of claim 1, wherein the arcuate wall elongated slot comprises opposite end portions and wherein a respective post extends from the housing arcuate wall surface adjacent each elongated slot end portion, wherein the posts are configured to limit movement of the flexible sleeve relative to the elongated slot.

10. The clamping apparatus of claim 1, wherein the upper member front face comprises a recessed portion, and wherein the flexible sheet dispenser is removably secured to the upper member front face within the recessed portion.

11. The clamping apparatus of claim 1, wherein the base member comprises a rear surface and a magnet attached thereto that is configured to removably secure the clamping apparatus to a magnetically attractive surface.

12. The clamping apparatus of claim 1, wherein the base member and upper member comprise polymeric material.

13. A clamping apparatus, comprising:

a base member;

an upper member comprising a front face, opposite end portions, an edge portion, and a respective aperture formed therein adjacent each end portion, and wherein the upper member is movably secured to the base member for pivotal movement about an axis;

a biasing member that biases the upper member about the axis such that the upper member edge portion is biased towards the base member to retain items placed therebetween; and a flexible sheet dispenser removably secured to the upper member front face, wherein the flexible sheet dispenser comprises:

a housing, comprising:

an arcuate wall having an elongated slot formed therein, wherein the arcuate wall includes opposite elongated edge portions, opposite end portions, an arcuate surface, and a pair of retaining members each of which protrudes from the arcuate wall surface adjacent a respective one of the arcuate wall edge portions; and a pair of end walls depending from respective opposite end portions of the arcuate wall, wherein each housing end wall comprises a locking tab depending therefrom that is configured to be inserted within a respective one of the upper member apertures so as to removably secure the housing to the upper member front face; and a flexible sleeve configured to individually dispense flexible sheets from a stack disposed within the flexible sleeve, wherein the flexible sleeve comprises opposite edge portions that are engaged by the retaining members such that the flexible sleeve is maintained in arcuate, face-to-face contacting relationship with the arcuate wall surface, and wherein a free end of an uppermost sheet in the stack extends through the arcuate wall elongated slot.

14. The clamping apparatus of claim 13, wherein each retaining member comprises an elongated rib that protrudes from the arcuate wall surface and extends along a direction substantially parallel with a respective one of the arcuate wall edge portions.

15. The clamping apparatus of claim 13, wherein the flexible sleeve comprises:

a generally planar base section having opposite edge portions; and a pair of elastically deformable members each extending from a respective base section edge portion toward the other elastically deformable member in overlapping spaced relationship to the base section, wherein each elastically deformable member has a free edge that is spaced from and opposing the other elastically deformable member free edge, thereby defining an opening therebetween through which a free end of an uppermost sheet in the stack extends.

16. The clamping apparatus of claim 13, wherein a plurality of stacks of flexible sheets are disposed within the flexible sleeve in adjacent, spaced-apart relationship, and wherein a free end of an uppermost sheet in each stack extends through the arcuate wall elongated slot.

17. The clamping apparatus of claim 13, wherein the arcuate wall elongated slot comprises opposite end portions and wherein a respective post extends from the housing arcuate wall surface adjacent each elongated slot end portion, wherein the posts are configured to limit movement of the flexible sleeve relative to the elongated slot.

18. The clamping apparatus of claim 13, wherein the upper member front face comprises a recessed portion, and wherein the flexible sheet dispenser is removably secured to the upper member front face within the recessed portion.

19. A clamping apparatus, comprising:

a base member;

an upper member including a front face and an edge portion, the upper member movably secured to the base member for pivotal movement about an axis;

a biasing member that biases the upper member about the axis such that the upper member edge portion is biased towards the base member to retain items placed therebetween; and a flexible sheet dispenser removably secured to the upper member front face, wherein the flexible sheet dispenser comprises:

a housing, comprising:

an arcuate wall having an elongated slot formed therein, wherein the arcuate wall comprises opposite elongated edge portions, opposite end portions, an arcuate surface, and an arcuate surface, and a pair of retaining members each of which protrudes from the arcuate wall surface adjacent a respective one of the arcuate wall edge portions; and a pair of end walls depending from respective opposite end portions of the arcuate wall; and a flexible sleeve configured to individually dispense flexible sheets from a stack disposed within the flexible sleeve, wherein the flexible sleeve comprises:

a generally planar base section having opposite edge portions that are engaged by the retaining members such that the flexible sleeve is maintained in face-to-face contacting relationship with the arcuate wall surface; and a pair of elastically deformable members each extending from a respective base section edge portion toward the other elastically deformable member in overlapping spaced relationship to the base section, wherein each elastically deformable member has a free edge that is spaced from and opposing the other elastically deformable member free edge, thereby defining an opening therebetween through which a free end of an uppermost sheet in the stack extends.

20. The clamping apparatus of claim 19, wherein each retaining member comprises an elongated rib that protrudes from the arcuate wall surface and extends along a direction substantially parallel with a respective one of the opposite edge portions.

21. The clamping apparatus of claim 19, wherein the upper member front face comprises opposite end portions and a respective aperture formed therein adjacent each front face end portion, and wherein each housing end wall comprises a locking tab depending therefrom that is configured to be inserted within a respective one of the apertures so as to removably secure the housing to the upper member front face.

22. The clamping apparatus of claim 19, wherein the arcuate wall elongated slot comprises opposite end portions and wherein a respective post extends from the housing arcuate wall surface adjacent each elongated slot end portion, wherein the posts are configured to limit movement of the flexible sleeve relative to the elongated slot.

23. The clamping apparatus of claim 19, wherein the upper member front face comprises a recessed portion, and wherein the flexible sheet dispenser is removably secured to the upper member front face within the recessed portion.

24. A clamping apparatus, comprising:

a base member;

an upper member including a front face and an edge portion, wherein the upper member front face comprises opposite end portions and a respective aperture formed therein adjacent each front face end portion, the upper member movably secured to the base member for pivotal movement about an axis, wherein the front face is configured to removably secure any of a plurality of articles thereon, wherein the articles are selected from the group consisting of a flexible sheet dispenser, an electronic apparatus, and a writing instrument holder, and wherein each article comprises locking tabs depending therefrom that are configured to be inserted within the respective apertures so as to removably secure the article to the upper member front face; and a biasing member that biases the upper member about the axis such that the upper member edge portion is biased towards the base member to retain items placed therebetween.

25. The clamping apparatus of claim 24, wherein the article holder comprises a writing instrument holder.

26. The clamping apparatus of claim 24, wherein the electronic apparatus comprises a calculator.

27. The clamping apparatus of claim 24, wherein the flexible sheet dispenser comprises:

a housing, comprising:

an arcuate wall having an elongated slot formed therein, wherein the arcuate wall includes opposite elongated edge portions, opposite end portions and an arcuate surface; and a pair of end walls depending from respective opposite end portions of the arcuate wall; and a flexible sleeve configured to individually dispense flexible sheets from a stack disposed within the flexible sleeve, wherein the flexible sleeve is in arcuate, face-to-face contacting relationship with the arcuate wall surface, and wherein a free end of an uppermost sheet in the stack extends through the arcuate wall elongated slot.

28. A clamping apparatus, comprising:

a base member;

an upper member including a front face and an edge portion, wherein the upper member front face comprises opposite end portions and a respective aperture formed therein adjacent each front face end portion, the upper member movably secured to the base member for pivotal movement about an axis, wherein the front face is configured to removably secure any of a plurality of articles thereon;

a biasing member that biases the upper member about the axis such that the upper member edge portion is biased towards the base member to retain items placed therebetween; and a set of articles, each of which is configured to be removably secured to the upper member front face, and wherein the articles are selected from the group consisting of a flexible sheet dispenser, an electronic apparatus, and a writing instrument holder, and wherein each article comprises locking tabs depending therefrom that are configured to be inserted within the respective apertures so as to removably secure the article to the upper member front face.

29. The clamping apparatus of claim 28, wherein the article holder comprises a writing instrument holder.

30. The clamping apparatus of claim 28, wherein the electronic apparatus comprises a calculator.

31. The clamping apparatus of claim 28, wherein the flexible sheet dispenser comprises:

a housing, comprising:

an arcuate wall having an elongated slot formed therein, wherein the arcuate wall includes opposite elongated edge portions, opposite end portions and an arcuate surface; and a pair of end walls depending from respective opposite end portions of the arcuate wall; and a flexible sleeve configured to individually dispense flexible sheets from a stack disposed within the flexible sleeve, wherein the flexible sleeve is in arcuate, face-to-face contacting relationship with the arcuate wall surface, and wherein a free end of an uppermost sheet in the stack extends through the arcuate wall elongated slot.

32. A clamping apparatus, comprising:

a base member;

an upper member including a front face and an edge portion, the upper member movably secured to the base member for pivotal movement about an axis, wherein the front face is configured to removably secure any of a plurality of articles thereon, wherein the articles are selected from the group consisting of a flexible sheet dispenser, an electronic apparatus, and a writing instrument holder, and wherein the upper member comprises a first magnetic object;

a second magnetic object associated with each article and that is magnetically attracted to the first magnetic object; and a biasing member that biases the upper member about the axis such that the upper member edge portion is biased towards the base member to retain items placed therebetween.

33. A clamping apparatus, comprising:

a base member;

an upper member including a front face and an edge portion, the upper member movably secured to the base member for pivotal movement about an axis, wherein the front face is configured to removably secure any of a plurality of articles thereon, wherein the articles are selected from the group consisting of a flexible sheet dispenser, an electronic apparatus, and a writing instrument holder, a first part of a hook and loop fastener located on the upper member front face, and a second part of the hook and loop fastener located on each article, wherein the first and second parts of the hook and loop fastener releaseably seal to each other; and a biasing member that biases the upper member about the axis such that the upper member edge portion is biased towards the base member to retain items placed therebetween.

* * * * *